US010604917B2

(12) United States Patent
Bartenstein

(10) Patent No.: US 10,604,917 B2
(45) Date of Patent: Mar. 31, 2020

(54) FLUSHING STATION FOR A RING-PIPE OR SERIES-PIPE SYSTEM, RING-PIPE SYSTEM AS WELL AS SERIES-PIPE SYSTEM

(71) Applicant: UPONOR INNOVATION AB, Virsbo (SE)

(72) Inventor: Paul Bartenstein, Westhausen (DE)

(73) Assignee: UPONOR INNOVATION AB, Virsbo (SE)

( * ) Notice: Subject to any disclaimer, the term of this patent is extended or adjusted under 35 U.S.C. 154(b) by 66 days.

(21) Appl. No.: 15/434,681

(22) Filed: Feb. 16, 2017

(65) Prior Publication Data

US 2017/0241113 A1 Aug. 24, 2017

(30) Foreign Application Priority Data

Feb. 18, 2016 (DE) ..... 20 2016 100 853

(51) Int. Cl.

| | |
|---|---|
| ***E03B 7/08*** | (2006.01) |
| ***B08B 9/032*** | (2006.01) |
| ***E03B 7/00*** | (2006.01) |
| ***E03B 7/04*** | (2006.01) |
| ***E03B 7/09*** | (2006.01) |

(52) U.S. Cl.

CPC ..... *E03B 7/08* (2013.01); *B08B 9/0325* (2013.01); *E03B 7/006* (2013.01); *E03B 7/04* (2013.01); *E03B 7/095* (2013.01); *Y10T 137/698* (2015.04)

(58) Field of Classification Search

CPC . E03B 7/006; E03B 7/08; E03B 7/095; Y10T 137/698; B08B 9/0325

See application file for complete search history.

(56) References Cited

U.S. PATENT DOCUMENTS

| | | | | |
|---|---|---|---|---|
| 7,270,144 | B2 * | 9/2007 | Minnick | B05C 5/0216 137/360 |
| 2002/0134431 | A1 * | 9/2002 | Kopp | A47L 15/4217 137/360 |
| 2012/0234398 | A1 * | 9/2012 | Leymann | E03B 7/006 137/15.05 |
| 2016/0215911 | A1 | 7/2016 | Bartenstein | |

FOREIGN PATENT DOCUMENTS

| | | |
|---|---|---|
| DE | 102013001584 | 7/2014 |
| DE | 202013100762 | 7/2014 |
| DE | 202013102154 | 9/2014 |
| DE | 202014105702 | 1/2015 |
| EP | 1964983 | 3/2007 |
| WO | WO 2005/124494 | 12/2005 |
| WO | WO 2014/040823 | 3/2014 |

OTHER PUBLICATIONS

Machine translation of EP 1964983.*

* cited by examiner

*Primary Examiner* — Kevin F Murphy
(74) *Attorney, Agent, or Firm* — Haynes Beffel & Wolfeld LLP; Andrew L. Dunlap

(57) ABSTRACT

A flushing station for a ring-pipe or series-pipe system, comprises a cold water port for connecting a cold-water pipe, a hot water port for connecting a hot water pipe, and a waste water port, wherein the cold-water port and the hot water port are fluidicly coupled to the waste water port. The cold-water port, the hot water port and the waste water port are assigned to a bottom side of the flushing station.

12 Claims, 3 Drawing Sheets

Figure 1:
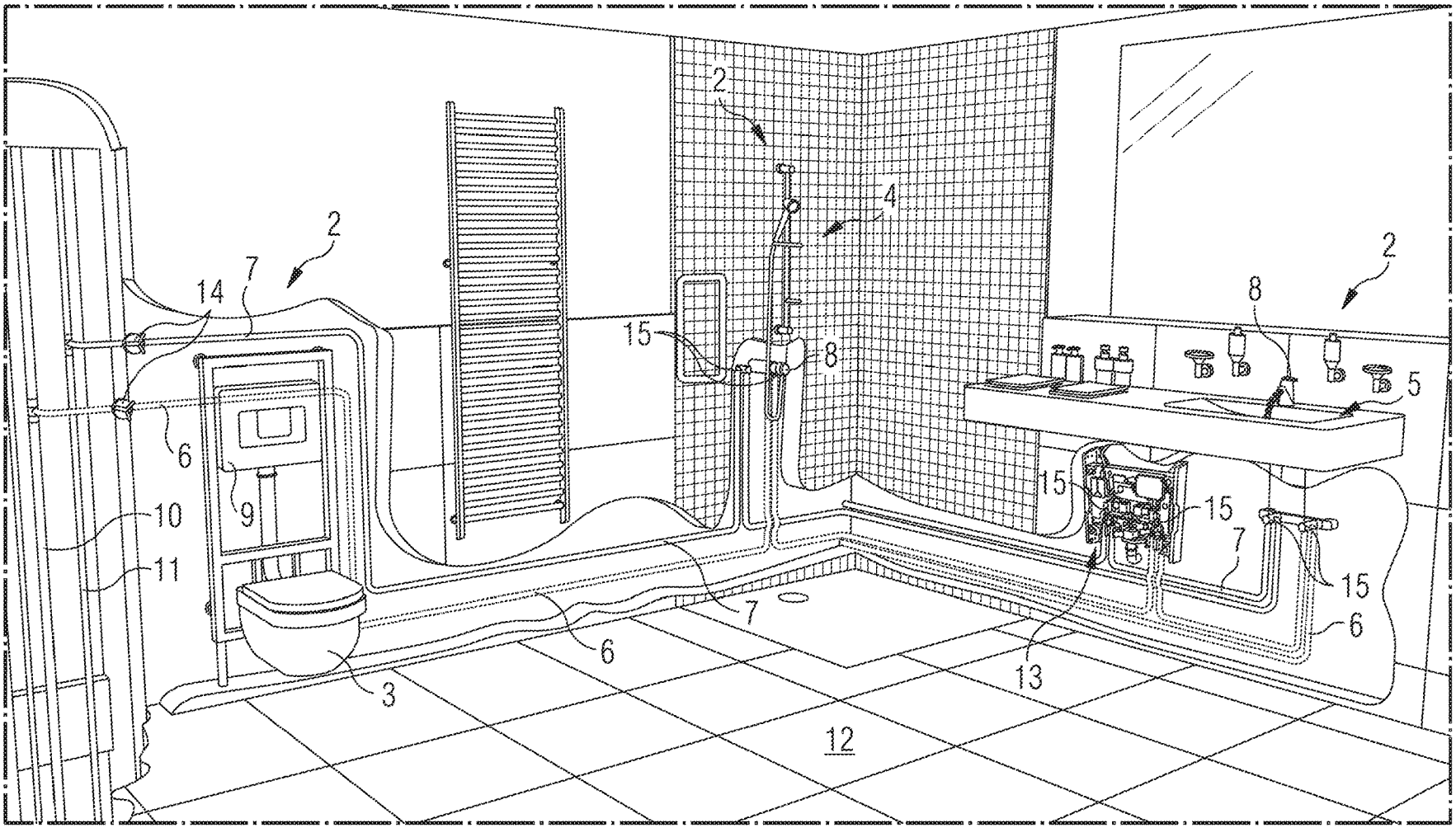

FLUSHING STATION FOR A RING-PIPE OR SERIES-PIPE SYSTEM, RING-PIPE SYSTEM AS WELL AS SERIES-PIPE SYSTEM

RELATED APPLICATION

This application claims priority to German Application No. 202016100853.0 filed on Feb. 18, 2016, the contents of which are hereby incorporated by reference in their entirety.

DESCRIPTION

Flushing station for a ring-pipe or series-pipe system, ring-pipe system as well as series-pipe system The invention relates to a flushing station for a ring-pipe or series-pipe system. Furthermore, the invention relates to a series-pipe system as well as to a ring-pipe system each having a flushing station.

Nowadays, ring-pipe or series-pipe systems are installed for preference when installing water pipes. In series-pipe systems, hot water and/or cold water pipe lines in one room of a building or on one floor of a building are led in series from consumer to consumer. A last consumer of the consumers connected in series should be a frequently used consumer, for example, a washbasin of a bathroom. This ensures that when using this last consumer, water is flushed through all upstream pipe lines sections of the cold water and/or hot water pipes of the room or the floor. This avoids areas of stagnation in pipe sections, where water is not flushed or only unfrequently flushed, e.g. in an unfrequently used bath tub. Such areas of stagnation would often cause hygienic flaws, in particular due to the formation of bacteria (e.g. legionella).

In ring-pipe systems, in addition to the series-pipe systems, cold water or hot water pipe lines are laid from the last consumer to the start of the series-piping. Thus, a pipe ring is formed for the cold water or hot water pipe lines. This has the advantage that every time a consumer is used, the water flows from both directions to the consumer and independently of the actuation of a consumer connected to the ring-pipe water always flows through all ring-pipe line sections.

In the above-described pipe line systems, flushing stations may additionally be used, which further improve the hygiene of such systems. Typically, a flushing station is installed in a series-pipe or ring-pipe system and automatically flushes them. In particular, this is of advantage if the series-pipe or ring-pipe system is not used at all for longer periods of time, for example if a flat, a house or part of a building are empty for a longer period of time.

One object underlying the invention is to provide a concept for a flushing station, which contributes to an efficient mounting process.

A flushing station for flushing a ring-pipe or series-pipe system is disclosed. The series-pipe or ring-pipe system is configured for a potable water installation, for example. The flushing station comprises a cold-water port for connecting a cold-water pipe as well as a hot water port for connecting a hot water pipe. Furthermore, the flushing station comprises a waste water port, wherein the cold-water port and the hot water port are fluidicly coupled to the waste water port. The flushing station is characterized in that the cold-water port, the hot water port and the waste water port are assigned to a bottom side of the flushing station.

Since all ports of the flushing station are assigned to one common side of the flushing station, the flushing station can be fluidicly coupled with pipe lines only via the common side. In other words, the pipe lines such as cold water, hot water and drain or waste water pipes are connected or fluidicly coupled to the flushing station exclusively via the common side. In yet other words, these ports are fluidicly connectable from a common side. For example, pipe connecting of the flushing station is effected merely at the common side thereof.

Preferably, the common side is the bottom side of the flushing station, wherein "bottom" means that this side is assigned to, in particular facing, the ground.

The described flushing station contributes to the fact that pipe lines can be mounted in an efficient manner. In particular, all pipe lines leading to the flushing station or leading away from the flushing station can be laid in a bundled manner via one side. In particular, laying individual pipes around the flushing station to establish a fluidic connection on another side of the flushing station, e.g. a top side, is not required. Furthermore, a contribution is made to that fact that fewer pipe lines are needed, and in particular lengths of the pipe lines can be reduced. This saves production and mounting costs.

Typically, cold and hot water pipes are laid in the ground of a floor of a building or at least close to the ground and guided to the installed consumers such as wash basins or the like from the bottom up (against the direction of gravity). Since all ports are assigned to the bottom side of the flushing station, the pipes lines can be guided to the flushing station perpendicularly to the ground in the shortest possible way. Another advantage is that particularly few recesses for laying the pipe lines to the flushing station are to be provided or formed in particular in brickwork or massive walls. In particular, one or multiple suitable recesses for the pipes are only required at the common side of the flushing station. Thus, the pipes can be efficiently connected to the flushing station. This helps saving significant time and thus installation costs particularly on a construction site.

According to one embodiment, the cold-water port, the hot water port and the waste water port are opened essentially toward a common plane. The common plane is opposite the common side of the flushing station. The common plane is, e.g. in a mounted state, a ground of a room of the building. For example, the common plane can be a virtual plane, which is opposite all openings of the described ports of the flushing station. Here, it is not necessarily required that cross-sections of the openings are arranged parallel to the common plane. Rather, it is also possible that the cross-sections of the openings of the ports are arranged at a certain angle to the common plane. In other words, all cross-sections of the openings of the ports or of the connection pipe are oriented toward the common plane at no more than an angle of less than 90°. This contributes to the efficient mounting process.

According to another embodiment, the cold-water port, the hot water port and the waste water port point in essentially the same direction. The direction is to be seen vectorially. In other words, the ports and the waste water port point in a direction away from the common side of the flushing station. This contributes to the efficient mounting process.

According to another embodiment, longitudinal axes of the cold-water port, the hot water port and the waste water port are oriented essentially parallel to one another. The longitudinal axes run essentially parallel to one another least in the area of the openings of the ports. Essentially parallel means that the longitudinal axes do not exclusively run parallel to one another, but can also be oriented to one another at a slight angular deviation, for example of a few degrees. This makes it possible to lay the pipe line for connecting to the cold-water port, hot water port and the waste water port parallel to one another and thus in an extremely space-saving manner. This enables a compact and space-saving laying of pipe lines. This contributes to the fact that only slight recesses need to be provided in walls or brickwork.

According to another embodiment, the longitudinal axes run in a common plane. Thus, the pipes are laid toward the flushing station and connected thereto in a common plane.

According to another embodiment, the cold-water port and/or the hot water port comprise a profiled support sleeve, a press sleeve and/or a plastic ring. Thus, pipe lines can be connected to the respective ports in a fast and simple manner. Typically, an end of a pipe line is slid between a press sleeve and a support sleeve and subsequently radially fixedly and tightly pressed using a pressing tool. For example, a plastic ring serves to secure the pressing sleeve to the support sleeve and may additionally comprise a press mark, which is separated during the pressing process by means of the pressing tool.

Alternatively, or additionally, the ports may also comprise an internal or an external thread for the connection or pipe lines.

According to another embodiment, the flushing station comprises a further cold water port and a further hot water port. The two further ports are configured in accordance with the ports described above. Thus, cold water pipes and hot water pipes can be connected to in each case both ports in the ways and manners described above, so that water can be guided from a cold water or hot water port to the further cold water or hot water port. This allows water to be looped through the hot and cold water pipes without that the water needs to be drained via the waste water port.

According to another embodiment, the two cold water ports and the two hot water ports are each part of a pipe connector piece, which is fluidicly coupled to the waste water port. The pipe connector piece is a double connector piece, for example, which is coupled fluidicly to the waste water port via a third port. The pipe connector pieces may form a part, in particular an integral part, of the flushing station. For example, the pipe connector piece is designed as a fitting. The pipe connector piece can be referred to as a loop-through fitting.

Preferably, the two cold water ports and the two hot water ports are each fluidicly connected via a U-shaped pipe section. Thus, the water can be looped from the first cold water port to the second cold water port via the U-shaped pipe section, without that the water necessarily needs to be drained via the further port of the pipe connector piece and the waste water port. Due to the U-shaped pipe section, a steady course of the pipe(s) is achieved between both cold-water ports and both hot water ports, respectively. This contributes to lower pressure losses in the pipe connector piece, when a medium such as water is guided through via the two cold water ports or hot water ports, respectively.

According to another embodiment, the flushing station comprises a housing, wherein the cold-water port and the hot water port, respectively the two cold water ports and the two hot water ports, are arranged inside the housing. Alternatively, or additionally, the waste water port of the flushing station is also arranged within the housing. In other words, the ports are encapsulated and/or cased in the housing of the flushing station. This contributes to a particularly compact design of the flushing station. For example, the housing of the flushing station comprises in each case one cylindrical recess for the ports, via which the pipe lines can be guided in the interior of the flushing station, to connect them to the respective ports. Such an arrangement also contributes to a simple and safe transport without the cold or hot water ports being damaged. Furthermore, this contributes to the fact that the ports do not take physical damage at the construction site or during the mounting process by contact with other objects.

Furthermore, a series-pipe system as well as a ring-pipe system for a building is described. Each system comprises one hot water pipe and one cold water pipe, respectively, as well as one or multiple consumers, which are connected to the hot water pipe and/or the cold-water pipe. Furthermore, each system comprises a flushing station according to one of the above-mentioned configurations, which are arranged in or at a wall of the building. The hot water pipe and the cold-water pipe are connected to the cold-water port and the hot water port of the flushing station via a bottom side of the flushing station facing a ground of the building.

Such systems essentially enable the above-mentioned advantages and functions. In particular, pipe lines are connected to the flushing station merely via the bottom side of the flushing station, so that the pipe lines can be laid in the shortest possible way to the flushing station.

Further advantageous embodiments are disclosed in the following, detailed description of an exemplary embodiment.

The exemplary embodiment will hereinafter be described with reference to the attached figures. Like or equivalent elements are indicated with like reference numerals throughout the figures.

Figure 2:
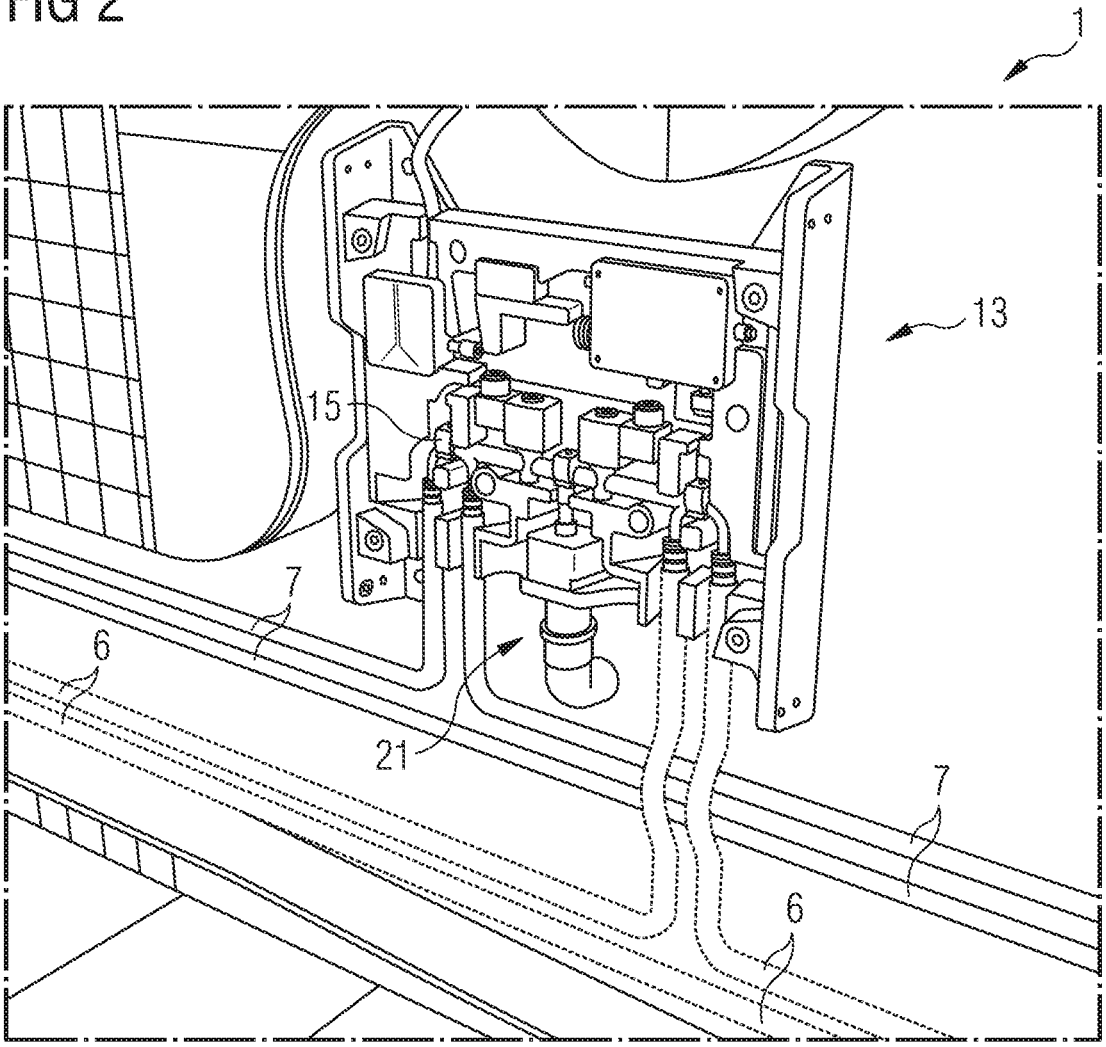
Figure 3:
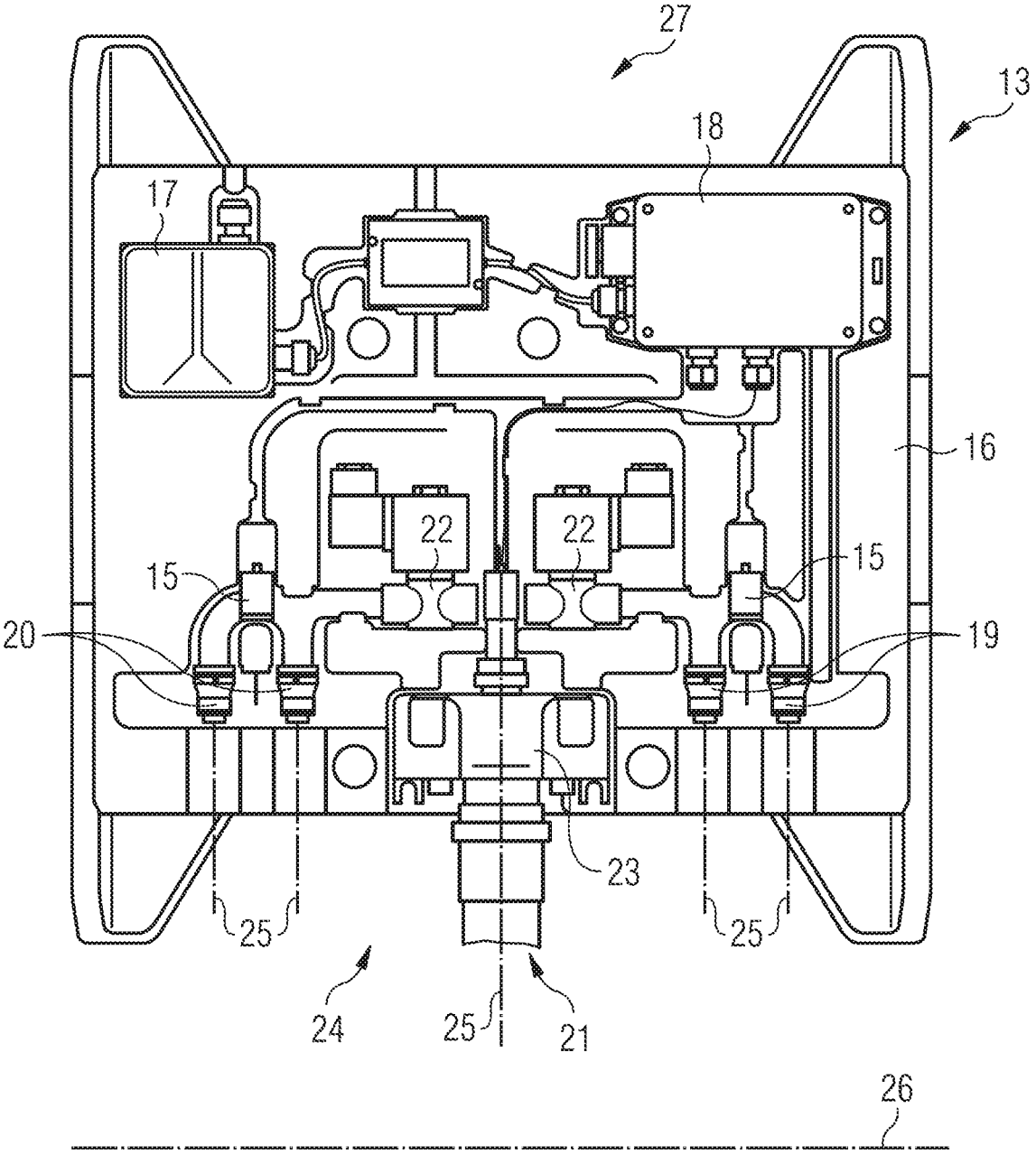

The figures show in:

FIG. 1 a perspective, schematic illustration of a ring-pipe system with a flushing station, FIG. 2 an enlarged sectional view of the ring-pipe system according to FIG. 2 with the flushing station, and FIG. 3 a view of the flushing station.

FIG. 1 shows a schematic perspective view of a ring-pipe system 1 (not completely illustrated) for one floor of a building. A bathroom is illustrated in FIG. 1 by way of example.

The ring-pipe system 1 comprises multiple consumers 2, namely a toilet 3, a shower 4 as well as a washbasin 5. The consumers 2 are fluidicly connected to a cold-water pipe 6 and/or a hot water pipe 7.

The cold-water pipe 6 and the hot water pipe 7 are connected to a cold water rising pipe 10 and a hot water rising pipe 11, respectively, via valves 14 and/or spigots. The cold water rising pipe 10 and the hot water rising pipe 11 are main supplies of a building and, usually, run from a house terminal vertically via various floors of the building. The cold-water pipe 6 as well as the hot water pipe 7 are mainly laid in the vicinity of a ground 12 of the bathroom.

In the exemplary embodiment, the cold-water pipe 6 leads to a flushing tank 9 of the toilet 3 starting from the cold water rising pipe 10. From the toilet 3, the cold-water pipe 6 is guided further to a mixer faucet 8 of the shower 4. From the shower 4, the cold-water pipe 6 is guided to a flushing station 13, which can also be referred to as hygienic flushing station. Subsequently, from the flushing station 13, the cold-water pipe 6 is guided to a mixer faucet 8 of the wash basin 5. After that, the cold-water pipe 6 is guided in another room of the building and guided back to a start of the ring-pipe system 1 from there (i.e. in the flow direction downstream the valves 14 upstream the consumers 2), to a branching point (not shown), for example.

The same applies to the hot water pipe 7. Starting from the hot water rising pipe 11, the hot water pipe 7 is directly guided to a mixer faucet 8 of the shower 4 downstream the valve 14. From the shower 4, the hot water pipe 4 is guided directly to the mixer faucet 8 of the wash basin 5, and from there to the flushing station 13. Starting from the flushing station 13, the hot water pipe 6 is guided in the further room of the building, in analogy to the cold-water line 6, and guided back to the start of the ring-pipe system 1.

The water pipes 6 and 7 are connected to the consumers 2 in such a way that these are routed or looped from one consumer to the next. Pipes 6, 7 are connected to the mixer faucets 8 or to the flushing station 13 via pipe connector pieces 15, which can also be referred to as double connector pieces or looping pieces. The respective hot or cold water pipe 6, 7 is directly routed to the next consumer 2 via a pipe connector piece 15, without that the respective consumer 2 is to be actuated.

As described above, the entire ring-pipe system 1, i.e. the entire cold water pipe 6 and/or the hot water pipe 7, is flushed upon actuation of one consumer 2, so that areas of stagnation can be prevented in pipes 6 and 7. For example, upon actuation of the shower 4, hot water and cold water is flushed to the shower 4 via pipes 6 and 7.

The flushing station 13 is provided to not leave the flushing of all pipes exclusively to the human hand. This ensures flushing the ring-pipe system 1 when none of the consumers 2 is actuated, which is why the water would normally be standing in pipes 6 and 7.

The flushing station 13, which is arranged in a wall of the bathroom, is described in greater detail with respect to FIGS. 2 and 3. FIG. 2 shows a sectional view of FIG. 1, which illustrates the flushing station 13 in an enlarged manner. FIG. 3 shows only the flushing station 13 in a front view.

The flushing station 13 comprises a housing 16, with multiple components of the flushing station 13 arranged therein. By way of example, a power supply unit 17 for connection to a power grid of the building may be mentioned. Furthermore, a control device 18 (also called controller) is provided, for example. The flushing station 13 has two pipe connector pieces 15, each having two cold water ports 19 or hot water ports 20, respectively. Each pipe connector piece 15 has a third port, via which the pipe connector piece is fluidicly coupled with a waste water port 21 of the flushing station 13. Valves are fluidicly arranged between every third port of a pipe connector piece 15 and the waste water port 21, the valves electrically controllable by means of the control device 18. The cold-water ports 19 or the hot water ports 20 are fluidicly coupled via a U-shaped pipe section of the corresponding pipe connector piece 15. The waste water port 21 is fluidicly coupled with an (upstream) protection device 23, so that the water is drained via the protection device and the waste water port via a waste water system. In other words, the waste water port 21 is connectable or connected to a waste water system. The protection device 23 prevents, in the case the drain is clogged, that water flows back into the cold water and hot water pipes 6, 7. Furthermore, the flushing station 13 comprises one or multiple sensors (not illustrated), which measure a temperature of a flow rate or a volume flow rate of the hot or cold water pipes 6, 7. The protection device 23 and the waste water port 21 can also be considered a unit, for example a waste water component.

The valves 22 are usually closed. However, if predetermined conditions are fulfilled, e.g. if a certain water temperature is not reached, the control device 18 opens one or both valves 22, so that water can be drained via the waste water port 21. In another example, the control device 18 briefly opens the valves 22 after 72 hours without actuation of a consumer 2. In other words, an automatic forced flushing is effected. Thus, the described areas of stagnation are prevented, since all sections of pipes 6, 7 are flushed.

As can be seen from FIGS. 1 to 3, all ports 19 and 20 as well as 21 are assigned to a bottom side 24 of the flushing station 13. This requires for all pipe lines and the drain being connected or fluidicly coupled to the flushing station 13 via the bottom side 24. In particular, rotational symmetry axes 25 of ports 19, 20 and 21 run parallel to one another. Openings of ports 19, 20 and 21 face a common virtual plane 26. Plane 26 runs parallel to the ground 12.

The flushing station 13 enables the above-mentioned advantage and functions.

As mentioned above, the cold and hot water pipes 6 and 7 are typically laid in close proximity to the ground. During the mounting process of the flushing station 13, pipes 6 and 7 are guided toward the bottom side 24 of the flushing station 13 merely vertically to the ground 12. It is thus not required to guide the hot or cold water pipe 6, 7 around the housing 13 of the flushing station 13 to an upper side 27 of the flushing station 13. This would require unnecessarily longer pipe lines, which increases material and installation costs. Moreover, the wall would have to be recessed in a significantly more pronounced fashion. Thus, the flushing station 13 can be mounted in an efficient manner, e.g. rapidly on a construction site.

The cold water and hot water ports 19 and 20 are arranged in the interior of the housing 16 of the flushing station 13. This provides the advantage that the flushing station 13 is very compact and ports 19, 20 do not protrude from the housing 16 prior to the mounting process, i.e. during proper installation of the flushing station 13. This is protected from physical damage and facilitates the transport as well, for example in terms of a stackability. Alternatively, or additionally, the waste water component (see above) is encapsulated in the housing 16. In other words, the waste water port 21 is encapsulated in the housing 16 and surrounded by a cover of the housing 16 or the flushing station 13, so that none of the ports 19, 20, 21 protrudes out of the flushing station beyond the bottom side.

In place of the ring-pipe system 1 described in FIGS. 1 to 3, it is also possible that a series-pipe system be installed, in which it is to be observed that the flushing station 13 is connected at the last place to the cold or hot water pipe 6 and 7, e.g. downstream all consumers of the series-pipe systems.

The invention is not limited by the illustrated embodiment. For example, the flushing station 13 is also suitable in other rooms than the described bathroom. It is also possible to use different or otherwise formed pipe connector pieces 15. The essential factor is that the ports 19, 20, 21 of the flushing station 13 are assigned to the bottom side 24.

The invention claimed is:

1. A flushing station comprising a housing;

a first pipe connector piece disposed within the housing and including a first U-shaped pipe section, a first cold-water input port, second cold-water output port and a third port, the first cold-water input port and the second cold-water output port being fluidicly coupled via the first U-shaped pipe section;

a second pipe connector piece disposed within the housing and including a second U-shaped pipe section, a first hot-water input port, a second hot-water output port and a third port, the first hot-water input port and the second hot-water output port being fluidicly coupled via the second U-shaped pipe section; and a waste-water port, wherein:

each third port of the first and second pipe connector pieces is fluidicly coupled with the waste-water port of the flushing station, a first valve is fluidicly arranged between the third port of the first pipe connector piece and the waste-water port, a second valve is fluidicly arranged between the third port of the second pipe connector piece and the waste-water port, the first and second valves are electrically controlled by a control device of the flushing station, such that, in response to predetermined conditions being fulfilled, the control device opens at least one or both of the first valve and the second valve allowing water to be drained via the waste-water port, the first and second cold-water ports and the first and second hot-water ports are arranged within the housing, the first and second cold-water ports, the first and second hot-water ports and the waste-water port are fluidicly coupled exclusively within the housing of the flushing station, the first and second cold-water ports are configured such that cold-water pipes of an external plumbing system enter the housing of the flushing station through a bottom side of the housing and connect to the first and second cold-water ports from the bottom side of the housing, the first and second hot-water ports are configured such that hot-water pipes of the external plumbing system enter the housing of the flushing station through the bottom side of the housing and connect to the first and second hot-water ports from the bottom side of the housing, the waste-water port is fluidicly connectable to a waste water system exclusively via a bottom side of the flushing station, the flushing station is configured to be installed in a ring pipe or series pipe system and to automatically flush pipes lines of the ring pipe or series pipe systems, wherein the first cold-water input port is fluidicly coupled to a first vertical leg of the first U-shaped pipe section, the second cold-water output port is fluidicly coupled to a second vertical leg of the first U-shaped pipe section, and the third port of the first pipe connector piece is fluidicly coupled to at least a portion of a curved portion of the first U-shaped pipe section and horizontally oriented such that the water to be drained via the waste-water port travels in a horizontal direction until the water reaches the waste water port, and the first hot-water input port is fluidicly coupled to a first vertical leg of the second U-shaped pipe section, the second hot-water output port is fluidicly coupled to a second vertical leg of the second U-shaped pipe section, and the third port of the second pipe connector piece is fluidicly coupled to at least a portion of curved portion of the second U-shaped pipe section and horizontally oriented such that the water to be drained via the waste-water port travels in a horizontal direction until the water reaches the waste water port.

2. The flushing station according to claim 1, wherein the first and second cold-water ports, the first and second hot-water ports the waste-water port are opened essentially toward a common plane.

3. The flushing station according to claim 2, wherein the first and second cold-water ports, the first and second hot-water ports and the waste-water port point essentially in the same direction.

4. The flushing station according to claim 1, wherein the first and second cold-water ports, the first and second hot-water ports and the waste-water port point essentially in the same direction.

5. The flushing station according to claim 1, wherein longitudinal axes of the first and second cold-water ports, the first and second hot-water ports and the waste-water port are oriented essentially parallel to one another.

6. The flushing station according to claim 5, wherein the longitudinal axes run in a common plane.

7. The flushing station according to claim 1, wherein at least one of (i) the first and/or second cold-water ports and (ii) the first and/or second hot-water ports comprise at least one of a profiled support sleeve, a press sleeve and a plastic ring.

8. A series-pipe system for a building comprising a hot-water pipe and a cold-water pipe;

one or multiple consumers, which are connected to the hot-water pipe and/or the cold-water pipe; and a flushing station according to claim 1, which is arranged in or at a wall of the building, wherein:

the hot-water pipe and the cold-water pipe are respectively connected to one of the first and second hot-water ports and one of the first and second cold-water ports of the flushing station at the bottom side of the flushing station facing a ground of the building, and the flushing station is configured to be installed in the series-pipe system and to automatically flush the series-pipe system.

9. A ring-pipe system for a building comprising a hot-water pipe and a cold-water pipe;

one or multiple consumers, which are connected to the hot-water pipe and/or the cold-water pipe; and a flushing station according to claim 1, which is arranged in or at a wall of the building, wherein:

the hot-water pipe and the cold-water pipe are respectively connected to one of the first and second hot-water ports and one of the first and second cold-water ports of the flushing station at the bottom side of the flushing station facing a ground of the building, and the flushing station is configured to be installed in the ring-pipe system and to automatically flush the ring-pipe system.

10. The flushing station according to claim 1, wherein none of the first and second cold-water ports, the first and second hot-water ports and the waste-water port protrude from the bottom side of the flushing station.

11. The flushing station according to claim 1, wherein one of the first and second cold-water ports is coupled to the waste-water port via the first valve within the housing and one of the first and second hot-water ports is coupled to the waste-water port via the second valve within the housing.

12. The flushing station according to claim 1, wherein the waste-water port extends through the bottom side of the flushing station at a location that is between the second cold-water output port and the first hot-water input port.

* * * * *